US009435330B2

(12) United States Patent
Tomter

(10) Patent No.: US 9,435,330 B2
(45) Date of Patent: Sep. 6, 2016

(54) COMPENSATED BARRIER AND LUBRICATION FLUIDS PRESSURE REGULATION SYSTEM FOR A SUBSEA MOTOR AND PUMP MODULE

(75) Inventor: Ole Petter Tomter, Nesøya (NO)

(73) Assignee: Vetco Gray Scandinavia AS, Vasteras (SE)

( * ) Notice: Subject to any disclaimer, the term of this patent is extended or adjusted under 35 U.S.C. 154(b) by 737 days.

(21) Appl. No.: 13/806,532

(22) PCT Filed: Jun. 20, 2011

(86) PCT No.: PCT/IB2011/001386

§ 371 (c)(1),
(2), (4) Date: Feb. 15, 2013

(87) PCT Pub. No.: WO2011/161515

PCT Pub. Date: Dec. 29, 2011

(65) Prior Publication Data

US 2014/0147299 A1 May 29, 2014

(30) Foreign Application Priority Data

Jun. 22, 2010 (NO) ..... 20100902

(51) Int. Cl.
*F04B 39/02* (2006.01)
*F04B 53/18* (2006.01)
(Continued)

(52) U.S. Cl.
CPC ..... *F04B 39/02* (2013.01); *F04B 53/18* (2013.01); *F04D 13/062* (2013.01); *F04D 25/06* (2013.01); *F04D 29/063* (2013.01); *F04D 29/122* (2013.01)

(58) Field of Classification Search
CPC ..... F04B 53/18; F04B 39/02; F04B 47/06; F04B 39/0207; F04D 13/062; F04D 25/06–25/0693; F04D 29/06–29/063; F04D 29/08–29/086; F04D 29/122; F04D 29/124; F04D 29/128; H02K 5/132
See application file for complete search history.

(56) References Cited

U.S. PATENT DOCUMENTS 2,423,825 A * 7/1947 Blom ..... 417/414
4,421,999 A 12/1983 Beavers et al.
(Continued)

FOREIGN PATENT DOCUMENTS

CN 1371455 A 9/2002
GB 315789 A 6/1930
(Continued)

OTHER PUBLICATIONS

International Search Report from corresponding PCT Application No. PCT/IB2011/001386, Dated Sep. 29, 2011.
(Continued)

*Primary Examiner* — Peter J Bertheaud
*Assistant Examiner* — Dnyanesh Kasture
(74) *Attorney, Agent, or Firm* — GE Global Patent Operation

(57) ABSTRACT

A compensated barrier and lubrication fluids pressure regulation system for a subsea motor and pump module is disclosed. The system comprises a hydraulic fluid supply, a barrier fluid circuit, and a lubrication fluid circuit. Hydraulic fluid in the barrier fluid circuit is pre-tensioned towards a motor by a first separating pressure compensator which is responsive to the pressure in the lubrication fluid circuit and which applies the sum of the pressure in the lubrication fluid circuit and an inherent pre-tensioning pressure to the barrier fluid circuit. Hydraulic fluid in the lubrication fluid circuit is pre-tensioned towards a pump by a second separating pressure compensator which is responsive to a pumped medium pressure at a suction side or at a discharge side of the pump and which applies the sum of the pumped medium pressure and an inherent pre-tensioning pressure to the lubrication fluid circuit.

13 Claims, 1 Drawing Sheet

(51) Int. Cl.

| | |
|---|---|
| ***F04D 13/06*** | (2006.01) |
| ***F04D 25/06*** | (2006.01) |
| ***F04D 29/063*** | (2006.01) |
| ***F04D 29/12*** | (2006.01) |

(56) References Cited

U.S. PATENT DOCUMENTS

| | | | | | |
|---|---|---|---|---|---|
| 4,460,181 | A | * | 7/1984 | Araoka | 277/318 |
| 4,614,482 | A | | 9/1986 | Gaffal | |
| 5,211,532 | A | | 5/1993 | Thompson | |
| 5,253,377 | A | * | 10/1993 | Larson | 5/679 |
| 5,795,135 | A | | 8/1998 | Nyilas et al. | |
| 6,059,539 | A | | 5/2000 | Nyilas et al. | |
| 6,076,557 | A | | 6/2000 | Carney | |
| 6,158,967 | A | | 12/2000 | Dupre | |
| 6,641,140 | B1 | | 11/2003 | Matsumoto et al. | |
| 6,655,932 | B1 | | 12/2003 | Stinessen et al. | |
| 8,113,792 | B2 | * | 2/2012 | De Boer | 417/228 |
| 8,485,797 | B2 | * | 7/2013 | Martinez et al. | 417/414 |
| 2008/0038132 | A1 | * | 2/2008 | Ihara et al. | 418/3 |
| 2008/0203337 | A1 | * | 8/2008 | Roundy | 251/59 |

FOREIGN PATENT DOCUMENTS

| | | |
|---|---|---|
| WO | 9853182 | 11/1998 |
| WO | 2008115064 | 9/2008 |

OTHER PUBLICATIONS

Unofficial English Translation of Chinese Office Action and Search Report issued in connection with corresponding CN Application No. 201180030717.5 on Nov. 3, 2014.

* cited by examiner

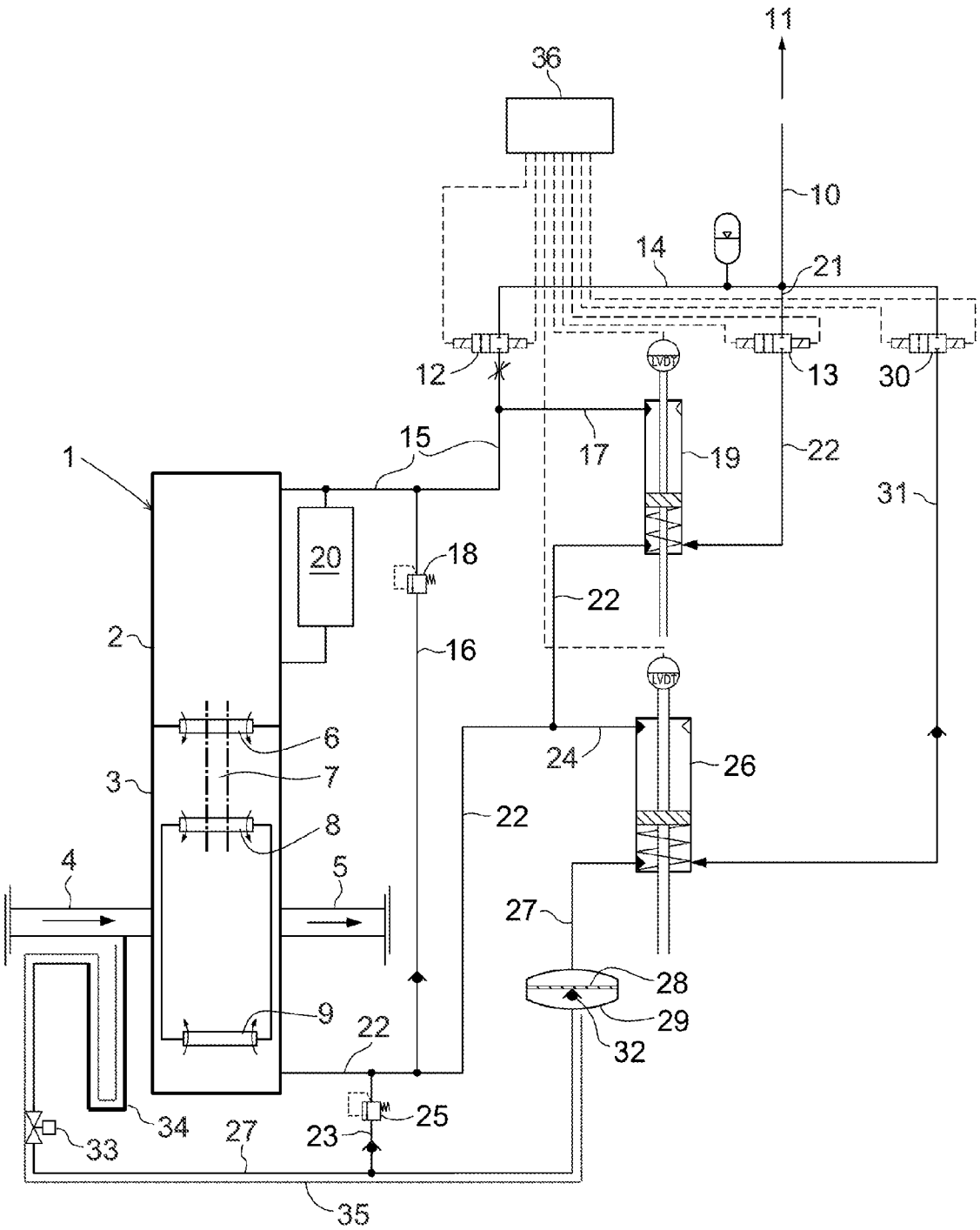
11
36
10
14
21
12
13
30
LVDT
15
17
19
22
1
31
20
18
22
2
16
LVDT
6
24
26
3
7
22
8
4
5
27
28
9
29
22
32
25
34
27
23
33
35

COMPENSATED BARRIER AND LUBRICATION FLUIDS PRESSURE REGULATION SYSTEM FOR A SUBSEA MOTOR AND PUMP MODULE

CROSS REFERENCE TO RELATED APPLICATIONS

This is a national stage application under 35 U.S.C. §371(c) prior-filed, co-pending PCT patent application serial number PCT/IB2011/001386, filed on Jun. 20, 2011, which claims priority to Norwegian Patent Application No. 20100902, filed on Jun. 22, 2010, the entire contents of which are incorporated herein by reference.

BACKGROUND OF THE INVENTION

Embodiments of the present invention relate generally to subsea equipment involved in the transport of hydrocarbon production fluids from a production site at the sea floor to a sea surface or land based host facility. More specifically, embodiments of the present invention are related to a system that is designed for management of barrier and lubrication fluid pressures in a subsea motor and pump module.

A process fluid in subsea hydrocarbon production is typically a multiphase fluid comprising oil and gas and eventually solid matter, which is extracted from an underground reservoir. A motor/pump module is arranged on the sea floor and configured for transport of the process fluid from the reservoir to a surface or land based host facility. The motor/pump module is frequently subjected to substantial variations in pressure in the pumped medium, as well as substantial transitional loads during pump start and stop sequences, for example, the medium pressure at the suction side of the pump may be in the order of hundreds of bar, requiring corresponding measures in the motor/pump module to prevent process fluid and particulate matter from immigration from the pump interior into a motor housing, and into bearings and seals of the motor/pump module.

For the purpose of pumping a multiphase fluid in subsea production, screw rotor pumps are used. The screw rotor pump is a positive displacement type of pump having two screw shafts that are driven in rotation with intermeshing gears, between which a specific volume of fluid is displaced in the axial direction of the screws from a suction side of the pump to be discharged on the pressure side of the pump. The screws are journalled in bearings in a pump housing, and are drive-connected to a motor arranged in a motor housing. In case of a twin rotor screw pump, intermeshing timing gears carried on the screw shafts provide synchronization of the rotary motion. The motor housing interior is hydraulically separated from the pump housing interior by a seal arrangement, where the drive shaft is journalled to extend for connection with the pump rotor shaft. The pump bearings are separated from the pump medium by seal arrangements at both ends of the pump.

A hydraulic fluid in the motor housing is controlled at a pressure above the internal pressure of the pump, acting as a barrier which prevents intrusion of process fluid and particles into the motor housing via the seal and bearing arrangement. As a result of the pressure difference, a leak flow of hydraulic fluid along the drive shaft is unavoidable. The leakage rate is dependent on fluid properties, differential pressure, the transient operating conditions of the pump, and the tightness of the seal(s). The leakage is compensated by refilling the motor housing from an external supply of hydraulic fluid. Likewise, hydraulic fluid is used for lubrication of pump bearings and timing gears. The pressure in the pump lubrication fluid is to be maintained above the pressure of the pumped medium internally of the pump, in order to prevent intrusion of process fluid and particles into pump bearings, seals and timing gears. Leakage via the pump seals into the pumped medium is compensated by refilling from an external supply of hydraulic fluid.

The motor and pump can be drive-connected inside the motor housing, or outside the motor housing. For instance, the motor and pump can share one and the same shaft with no separate coupling that connects them in a driving relation. In other designs the pump shaft can be coupled to the motor shaft inside the motor housing. In still other designs, the motor and pump is drive-connected by means of a coupling located in a coupling chamber defined between the motor housing and the pump. However, in all alternatives it is desirable to maintain at all times a pressure difference over the interfaces, i.e. between the motor housing, the coupling chamber when present, and the pump lubrication system and the pumped medium, respectively.

Conventionally, a motor barrier fluid and a pump lubrication fluid are each supplied from a host facility, and leakage compensation as well as pressure control is managed from the host facility, usually via an umbilical. As subsea hydrocarbon production sites are increasingly installed and operated at increasing depths and step-out distances, the response times and control requirements in lubrication and cooling systems increase correspondingly. As a consequence, there is a rising need for a barrier fluid and lubrication system that operates with improved control requirements and which provides increased reliability in operation.

BRIEF SUMMARY OF THE INVENTION

Embodiments of the present invention provide a barrier and lubrication fluids pressure regulation system for a subsea motor and pump module which avoids the problems of prior art systems, and specifically those problems which are associated with long step-out distances and great water depths.

According to an embodiment of the present invention, there is provided a barrier and lubrication fluids pressure regulation system for a subsea motor and pump module. The system comprises an inherent capability to adapt to pressure changes in the pumped medium. An embodiment of the present invention provides a barrier and lubrication fluids pressure regulations system having an inherent capability to compensate for loss of hydraulic fluid caused by leakage via seals and bearings in the motor and pump module. An embodiment of the present invention provides a barrier and lubrication fluids pressure regulations system wherein a preset pressure differential between a barrier fluid circuit and a lubrication fluid circuit is automatically maintained at all times and balanced towards the pumped medium pressure.

The barrier and lubrication fluids pressure regulation system according to an embodiment of the present invention may be applied to a subsea motor and pump module which comprises a pump motor disposed in a motor housing; a pump disposed in a pump-housing having a pump inlet at a suction side and a pump outlet at a discharge side of the pump, and a pump-rotor assembly arranged there between and journalled in bearings in the pump-housing. The pump-rotor assembly is drive-connected to the motor through a drive-shaft that reaches between the motor and pump housings via a seal arrangement, and is configured to displace a fluid medium from the pump inlet for discharge via the pump outlet.

According to an embodiment of the present invention, there is provided a compensated barrier and lubrication fluids pressure regulation system is provided. The system comprises a hydraulic fluid supply configured to provide barrier fluid and pump lubrication fluid to a subsea motor and pump module; a barrier fluid circuit, in which the hydraulic fluid is pre-tensioned towards a motor of the subsea motor and pump module by a pressure applied from a first separating pressure compensator; and a lubrication fluid circuit, in which the hydraulic fluid is pre-tensioned towards a pump of the subsea motor and pump module by a pressure applied from a second separating pressure compensator. The second pressure compensator is responsive to a pumped medium pressure at a suction side or at a discharge side of the pump and applies the sum of the pumped medium pressure and an inherent pre-tensioning pressure of the second pressure compensator to the lubrication fluid circuit, and the first pressure compensator is responsive to the pressure in the lubrication fluid circuit and applies the sum of the pressure in the lubrication fluid circuit and an inherent pre-tensioning pressure of the first pressure compensator to the barrier fluid circuit.

A system according to the an embodiment of the present invention provides immediate response to any change in the pumped medium pressure, and is a simple and robust solution which continuously maintains a predetermined pressure difference between the barrier and lubrication fluid circuits, and which at all times keeps the circuit pressures in balance with the pressure of the pumped medium.

In an embodiment, the barrier fluid circuit and the lubrication fluid circuit are separately connectable to a hydraulic fluid supply via controllable on/off valves, respectively, and the lubrication fluid circuit communicates with the hydraulic fluid supply via a loading compartment of the first pressure compensator.

Embodiments provide inherent compensation for loss of hydraulic fluid caused by leakage through seals that separate the barrier and lubrication fluid circuits in the motor and pump module, as well as a compensation for leak flows into the pumped medium.

The pumped medium pressure at the suction or discharge side of the pump is communicated to the loading compartment of the second pressure compensator via a pilot line. In an embodiment, the pumped medium pressure is communicated to the second pressure compensator over a separating diaphragm included in the pilot line.

Embodiments provide immediate response to pressure variations in the pumped medium, while avoiding intrusion of process fluids, sea water and particulate matter into the pump lubrication circuit.

In an embodiment, the pilot line communicates with the hydraulic fluid supply via an optional on/off valve which is controllable for feeding hydraulic fluid to the suction side or to the discharge side of the pump via the pilot line and through a one-way valve permitting back flow through the diaphragm.

Embodiments provide means for flushing the pilot line and diaphragm housing with hydraulic fluid for the purpose of removing hydrocarbons that may potentially intrude into the pilot line and form into solid matter, such as hydrates or particles, which may obstruct an accurate communication of pumped medium pressure to the barrier and lubrication fluid circuits. Flushing may additionally have the purpose of resetting the position of the diaphragm to ensure proper communication.

In order to avoid interruption of operation caused by unexpected pressure build-up in the circuits, flow communication between the pump inlet or outlet and the barrier or lubrication fluid circuits, respectively, can be established via a pressure controlled safety relief valve opening into the pilot line.

For a number of applications it will be appropriate if the first and second pressure compensators are each set to deliver a differential pressure typically of about 5 bar (72.5 psig).

The first and second pressure compensators may each be associated with a sensing means which returns the compensator position to control logic. Depending on the type of pressure compensator, a sensing means may be realized as a linear variable differential transformer (LVDT) responsive to the position of a compensator piston. The sensor reads the actual compensator position and communicates with a control logic that operates the on/off valves. According to an embodiment, the control logic is designed to maintain a pressure compensator in idling position by operating the on/off valve to refill the subject fluid circuit. The control logic is in this way effective for conversion of the compensator position into compensator pressure and thereby also into barrier fluid and pump lubrication pressures.

The barrier fluid circuit may comprise a cooler unit external to the motor housing.

Without being limited to any specific type or model of motor and pump module, the barrier fluid and lubrication system of the invention is applied to a pump equipped with a twin-screw rotor, and the lubrication circuit arranged to supply oil to pump bearings, as well as to timing gears that are installed in the pump for synchronizing the rotation of the rotors.

BRIEF DESCRIPTION OF THE DRAWING

The accompanying drawing illustrates exemplary embodiments, wherein:

FIG. 1 is a schematic drawing of a system according to an embodiment of the present invention.

DETAILED DESCRIPTION OF EXEMPLARY EMBODIMENTS OF THE INVENTION

In the following, embodiments of the present invention will be described in more detail with reference made to the accompanying, schematic drawing, FIG. 1.

In the drawing, reference number 1 refers to a subsea motor and pump module comprising a motor that is encased in a pressurized, water tight enclosure or motor housing 2, as well as a pump rotor assembly encased in a pump housing 3. The motor driving the pump is typically an electric motor, although other drive units such as hydraulic motors or turbines may alternatively be employed.

The pump rotor is configured for displacement of a pumped medium, typically a multi-phase production fluid from a reservoir below the sea floor, which enters the pump housing via a pump inlet 4 on the suction side of the pump, to be discharged via a pump outlet 5 on the discharge side of the pump. The pump rotor is drive-connected to the motor, and the pump interior is hydraulically separated from the pressurized (typically oil-filled) motor housing by means of a seal arrangement 6 which seals against the outside of a rotary shaft (indicated by reference number 7) by which the pump rotor is drive-connected to the motor. The pump bearings are separated from the pump medium by seal arrangements 8 and 9 at both ends of the pump. The pump rotor is journalled in bearing arrangements (not shown) in the pump housing 3.

Since embodiments of the present invention are not limited to any specific type or model of motor and pump assembly, but indeed can be applied to various motor and pump configurations which are involved in the transport of a hydrocarbon production fluid and operated by the skilled person, the internals of the motor and pump module 1 need not be discussed in detail.

Hydraulic fluid is supplied to the motor and pump module 1 via line 10 from a hydraulic fluid supply (indicated by reference 11), which may be located topside on a surface platform, or on a land based host facility. All other components of the compensated barrier and lubrication fluids pressure regulation system may be installed subsea.

The hydraulic fluid is supplied via flow control valves 12 and 13 which are controllable and switched between on and off modes in response to a demand for refilling the system based on changes in fluid pressure in the barrier and lubrication fluid circuits.

In an embodiment, the on/off valve 12 serves for refilling of a motor barrier fluid circuit comprising lines 14, 15, and 17 in the drawing. Line 14 connects the motor barrier fluid circuit with the hydraulic fluid supply via the on/off valve 12. Line 15 opens for hydraulic fluid into the motor housing interior, acting as a barrier at the interface between the motor and pump housings 2 and 3 and typically also providing lubrication and cooling fluid for the motor. The barrier fluid circuit is indirectly connectable for flow communication with the pump inlet via line 16 which serves, as an additional safety function, for dumping hydraulic fluid from the barrier fluid circuit via a safety relief valve 18 in case of an unexpected rise of the fluid pressure to too high of a level. The fluid pressure in the barrier fluid circuit is controlled by the fluid pressure in line 17, which opens into line 15 from a first pressure compensator 19 which applies a bias to the barrier fluid circuit as will be described more closely below. A cooler 20 may be incorporated in the barrier fluid circuit.

Similarly, the on/off valve 13 serves for refilling of a pump lubrication fluid circuit comprising lines 21, 22 and 24. Line 21 connects the pump lubrication fluid circuit with the hydraulic fluid supply via the on/off valve 13. Line 22 opens for hydraulic fluid into the pump housing, providing for lubrication of pump rotor bearings and, if appropriate, lubrication of timing gears. More precisely, the on/off valve 13 feeds hydraulic fluid into the lubrication circuit via the loaded compartment of the first pressure compensator 19, adding the fluid pressure in the lubrication circuit to the inherent pre-tensioning pressure that is set in the pressure compensator 19 which applies the sum of these pressures to the barrier fluid circuit, via line 17. Line 23 is indirectly connectable with the pump inlet as will be described below, and serves as an additional safety function for dumping hydraulic fluid from the pump lubrication fluid circuit via a safety relief valve 25, in case of an unexpected rise of the fluid pressure to a too high level. The fluid pressure in the lubrication fluid circuit is controlled by the fluid pressure in line 24, which opens into line 22 from a second pressure compensator 26 which applies a bias to the lubrication fluid circuit.

As a result, the fluid pressures in the barrier and lubrication fluid circuits are in this way mutually balanced to maintain a constant pressure difference between the two circuits at all actual fluid pressures in the lubrication fluid circuit. The pressure differential is determined by the bias of the first pressure compensator 19, which may be controllable. A pressure differential of typically about 5 bar (72.5 psig) is in most cases considered appropriate.

In addition, the fluid pressures in the barrier and pump lubrication fluid circuits are together balanced relative to the pressure of the pumped medium at the suction side of the pump. To this purpose, the medium pressure is communicated to the loaded compartment of the second pressure compensator 26, via line 27, adding the pressure of the pumped medium to the inherent pre-tensioning pressure that is set in the pressure compensator 26 which applies the sum of these pressures to the pump lubrication circuit, via line 24.

As a result, the fluid pressures in the barrier and lubrication fluid circuits are in this way together balanced with respect to the pressure in the pumped medium at the suction side of the pump. The pressure differential is determined by the bias of the second pressure compensator 26, which may be controllable. A pressure differential of typically about 5 bar (72.5 psig) is in most cases considered appropriate.

The pumped medium pressure is communicated to the loaded compartment of the second pressure compensator 26 via a separating diaphragm 28 which is incorporated in the pilot line 27. The diaphragm effects isolation of the pumped medium from the motor barrier and pump lubrication circuits.

For the purpose of cleaning the pilot line 27 and the diaphragm housing 29 from deposits of solids that may enter together with the pumped medium, a flushing circuit is provided in the barrier and lubrication fluids pressure regulation system. Flushing may additionally serve the purpose to reset the position of the diaphragm to ensure proper communication. The flushing circuit comprises an on/off valve 30 incorporated in a line 31 connecting the hydraulic fluid supply with the loaded compartment of the second pressure compensator 26. A one way valve 32 arranged in the diaphragm 28 permits back flushing of hydraulic fluid to the pumped medium inlet 4, via the second pressure compensator, the diaphragm and the pilot line.

The compensators will normally manage a rise of pressure in the barrier and lubrication fluid circuits. In order to manage a situation of excessive pressure in any of the circuits, additional safety functions may be installed. In the drawing, these additional safety functions are represented by the lines 23 and 16 which are connected, directly and indirectly, respectively, to the pilot line 27 as illustrated. Reverse flow in lines 16 and 23 is prevented through one way valves incorporated downstream of the safety relief valves 18 and 25.

Likewise in order to manage a sudden critical situation, such as hydrocarbon detection external to the pump e.g., an isolation valve 33 is arranged to cut pressure communication between the pumped medium and the barrier and lubrication fluid circuits.

In order to avoid gas accumulation in the pilot line 27 and/or in the diaphragm housing 29, which would cause misreading of the actual medium pressure due to compression or hydrate formation, a pipe loop 34 can be included in the pilot line to effect capture of a gas phase portion of a multi-phase production fluid.

Further, in order to avoid hydrate formation and solidification of gaseous and liquid components of a multi-phase production fluid in the pilot line 27, the pilot line is associated with a heating trace 35 effective for maintaining the fluid temperature in the pilot line above a solidification temperature for these fluid components.

The pressure compensator 19 and 26 may be any available type of dome loading pressure compensator for use at full sea depth, and designed for separating the pilot fluid from the hydraulic circuit to be controlled at the subject range of pressures. According to an embodiment, a compensator may have an adjustable spring bias which is controllable to set a differential pressure in the order of about 5 bar. A pressure compensator suitable for the aimed purpose is equipped with a sensor that reads the compensator position and returns a signal to a control logic 36 that operates the valves 12 and 13 between on and off modes. In case of a compensator designed with a telescoping rod for visual indication of the compensator piston position, the sensor may be an LVDT-sensor. The control logic may be designed to maintain a compensator in an idling position by operating the subject on/off valve for refilling the subject fluid circuit, and in this way converting the compensator's piston position into compensator pressure and thereby also into motor barrier fluid or pump lubrication fluid pressure. The control logic may be located subsea, or remotely located to communicate with the barrier and lubrication fluids pressure regulation system electronically via an umbilical.

The present invention is not in any way restricted to the embodiments described above. On the contrary, many possibilities to modifications thereof will be apparent to a person with ordinary skill in the art without departing from the basic idea of the present invention such as defined in the appended claims.

What is claimed is:

1. A compensated barrier and lubrication fluids pressure regulation system for a subsea motor and pump module, the system comprising:

a hydraulic fluid supply configured to provide barrier fluid and lubrication fluid to the subsea motor and pump module;

a barrier fluid circuit in which the hydraulic fluid is pre-tensioned towards a motor of the subsea motor and pump module by a pressure applied from a first separating pressure compensator; and a lubrication fluid circuit in which the hydraulic fluid is pre-tensioned towards a pump of the subsea motor and pump module by a pressure applied from a second separating pressure compensator, wherein the second pressure compensator is responsive to a pumped medium pressure at a suction side or at a discharge side of the pump and applies the sum of the pumped medium pressure and an inherent pre-tensioning pressure of the second pressure compensator to the lubrication fluid circuit, and wherein when the pump is operational, the first pressure compensator is responsive to the pressure in the lubrication fluid circuit and applies the sum of the pressure in the lubrication fluid circuit and an inherent pre-tensioning pressure of the first pressure compensator to the barrier fluid circuit.

2. The system of claim 1, wherein the barrier fluid circuit and the lubrication fluid circuit are separately connectable to the hydraulic fluid supply through controllable on/off valves, and wherein the lubrication fluid circuit communicates with the hydraulic fluid supply through a loading compartment of the first pressure compensator.

3. The system of claim 2, wherein the pumped medium pressure is communicated to a loading compartment of the second pressure compensator through a pilot line.

4. The system of claim 3, wherein the pumped medium pressure is communicated to the second pressure compensator over a separating diaphragm of the pilot line.

5. The system of claim 4, wherein the pilot line communicates with the hydraulic fluid supply through an on/off valve, wherein the on/off valve is configured to feed hydraulic fluid to the suction side or to the discharge side of the pump through the pilot line and a one-way valve permitting back flow through the separating diaphragm.

6. The system of claim 3, wherein flow communication between the suction side or the discharge side of the pump and at least one of the barrier fluid circuit and the lubrication fluid circuit, is established through a safety relief valve opening into the pilot line.

7. The system of claim 1, wherein the first pressure compensator and the second pressure compensator are each configured to deliver a differential pressure of 5 bar.

8. The system of claim 5, wherein the first pressure compensator and the second pressure compensator are each associated with a sensor, wherein the sensor is configured to communicate a position of the associated pressure compensator to a control logic.

9. The system of claim 8, wherein the sensor is a linear variable differential transformer (LVDT) responsive to the position of a pressure compensator piston of the associated pressure compensator.

10. The system of claim 8, wherein the control logic is configured to maintain at least one of the first pressure compensator and the second pressure compensator in an idling position by operating the on/off valve to refill the respective fluid circuit.

11. The system of claim 1, wherein the barrier fluid circuit comprises a cooler unit external to a motor housing of the subsea motor and pump module.

12. The system of claim 1, wherein the motor is disposed in a motor housing, the pump is disposed in a pump housing comprising a pump inlet at the suction side of the pump and a pump outlet at the discharge side of the pump, and wherein the subsea motor and pump module further comprises a pump-rotor assembly arranged between the pump inlet and the pump outlet and journalled in bearings in the pump housing, wherein the pump-rotor assembly is drive-connected to the motor through a drive-shaft that reaches between the motor housing and the pump housing through a seal arrangement, and wherein the pump-rotor assembly is configured to displace a fluid medium from the pump inlet for discharge outlet of through the pump outlet.

13. The system of claim 1, wherein the pump is a twin-rotor screw pump, and wherein the lubrication fluid circuit is configured to supply oil to timing gears configured to synchronize the rotation of rotors of the pump.

* * * * *